US006637237B1

(12) United States Patent
Wei et al.

(10) Patent No.: US 6,637,237 B1
(45) Date of Patent: Oct. 28, 2003

(54) OLEFIN PLANT REFRIGERATION SYSTEM

(75) Inventors: Vitus Tuan Wei, Houston, TX (US); Qi Ma, Katy, TX (US); James Tzong-Chaur Wu, Houston, TX (US)

(73) Assignee: ABB Lummus Global Inc., Bloomfield, NJ (US)

( * ) Notice: Subject to any disclaimer, the term of this patent is extended or adjusted under 35 U.S.C. 154(b) by 0 days.

(21) Appl. No.: 10/121,151

(22) Filed: Apr. 11, 2002

(51) Int. Cl.[7] ..... F25J 1/00
(52) U.S. Cl. ..... 62/612
(58) Field of Search ..... 62/611, 612, 613, 62/614

(56) References Cited

U.S. PATENT DOCUMENTS 5,613,373 A * 3/1997 Grenier ..... 62/612
6,334,334 B1 * 1/2002 Stockmann et al. ..... 62/612

* cited by examiner

*Primary Examiner*—William C. Doerrler
(74) *Attorney, Agent, or Firm*—Alix, Yale & Ristas, LLP

(57) ABSTRACT

The refrigeration system for an ethylene plant comprises a closed loop tertiary refrigerant system containing methane, ethylene and propylene. The tertiary refrigerant from a compressor is separated into an inter-stage discharge and the final compressor discharge to produce a methane-rich vapor fraction and two levels of propylene-rich liquids so as to provide various temperatures and levels of refrigeration in various heat exchange stages while maintaining a nearly constant refrigerant composition flowing back to the compressor and with the bulk of the total return refrigerant flow going to the first stage compressor section. This tertiary system can also be applied to an ethylene plant with a high pressure demethanizer.

4 Claims, 1 Drawing Sheet

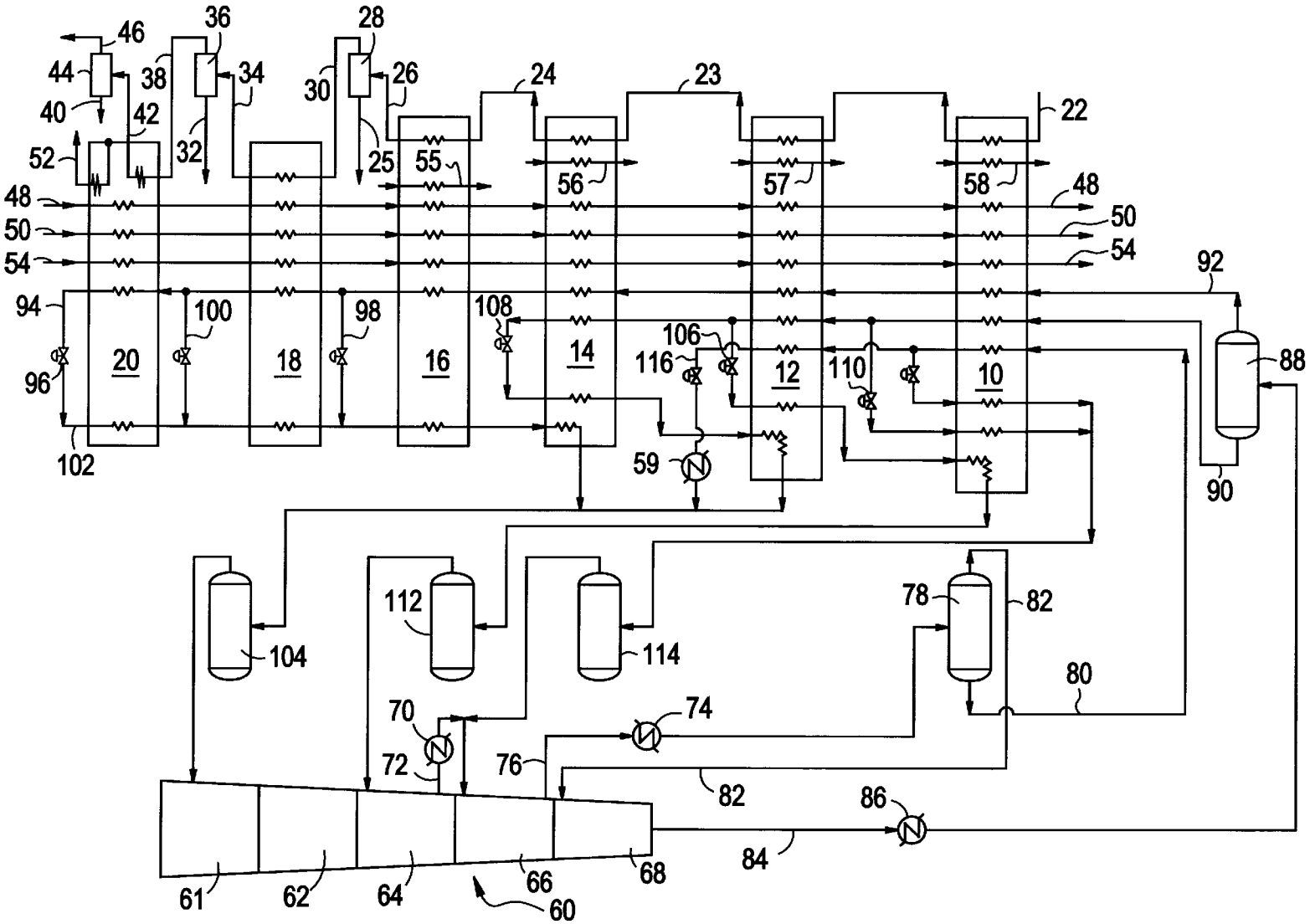
88
90
92
22
48
50
54
58
10
80
82
78
86
110
57
12
84
23
106
116
59
74
114
68
56
14
24
108
76
66
60
55
16
26
25
28
30
98
112
70
72
64
18
34
36
32
38
100
104
62
42
46
44
40
52
20
102
61
94
96

OLEFIN PLANT REFRIGERATION SYSTEM

BACKGROUND OF THE INVENTION

The present invention pertains to a refrigeration system to provide the cooling requirements of an olefin plant. More particularly, the invention is directed to the use of a tertiary or trinary refrigerant comprising a mixture of methane, ethylene and propylene for cooling in an ethylene plant.

Ethylene plants require refrigeration to separate out desired products from the cracking heater effluent. Typically, a propylene and an ethylene refrigerant are used. Often, particularly in systems using low pressure demethanizers where lower temperatures are required, a separate methane refrigeration system is also employed. Thus three separate refrigeration systems are required, cascading from lowest temperature to highest. Three compressor and driver systems complete with suction drums, separate exchangers, piping, etc. are required. An additional methane refrigeration compressor, either reciprocating or centrifugal, can partially offset the capital cost savings resulting from the use of low pressure demethanizers.

Mixed refrigerant systems have been well known in the industry for many decades. In these systems, multiple refrigerants are utilized in a single refrigeration system to provide refrigeration covering a wider range of temperatures, enabling one mixed refrigeration system to replace multiple pure component cascade refrigeration systems. These mixed refrigeration systems have found widespread use in base load liquid natural gas plants. The application of a binary mixed refrigeration system to ethylene plant design is disclosed in U.S. Pat. No. 5,979,177 in which the refrigerant is a mixture of methane and either ethylene or ethane. However, such a binary refrigeration system cascades against a separate propylene refrigeration system to provide the refrigeration in the temperature range of −40° C. and warmer. Therefore, two separate refrigeration systems are required.

SUMMARY OF THE INVENTION

It is an object of the present invention, therefore, to provide a simplified, single refrigeration system for an olefin plant, particularly an ethylene plant having a low pressure demethanizer, utilizing a mixture of methane, ethylene and propylene as a tertiary refrigerant. This tertiary system replaces the separate propylene, ethylene and methane refrigeration systems associated with a recovery process using a low pressure demethanizer. The invention involves the separation of the tertiary refrigerant from a compressor interstage discharge and the final compressor discharge into a methane-rich vapor fraction and two levels of propylene-rich liquids so as to provide various temperatures and levels of refrigeration in various heat exchange stages while maintaining a nearly constant refrigerant composition flowing back to the compressor and with the bulk of the total return refrigerant flow going to the first stage compressor suction. This enables the tertiary refrigerant system to compete favorably on a thermodynamic basis with the use of separate compressors for separate refrigerants. This tertiary system can also be applied to an ethylene plant with a high pressure demethanizer in which case the tertiary system only supplies propylene and ethylene refrigeration temperature levels. The objects, arrangement and advantages of the refrigeration system of the present invention will be apparent from the description which follows.

BRIEF DESCRIPTION OF THE DRAWING

The drawing is a schematic flow diagram of a portion of an ethylene plant illustrating one embodiment of the refrigeration system of the present invention.

DESCRIPTION OF THE PREFERRED EMBODIMENTS

The present invention relates to an olefin plant wherein a pyrolysis gas is first processed to remove methane and hydrogen and then processed in a known manner to produce and separate ethylene as well as propylene and some other by-products. The process will be described in connection with a plant which is primarily for the production of ethylene. The separation of the gases in an ethylene plant through condensation and fractionation at cryogenic temperatures requires refrigeration over a wide temperature range. The capital cost involved in the refrigeration system of an ethylene plant can be a significant part of the overall plant cost. Therefore, capital savings for the refrigeration system will significantly affect the overall plant cost.

Ethylene plants with high pressure demethanizers operate at pressures higher than 2.76 MPa (400 psi) with an overhead temperature typically in the range of −85° C. to −100° C. Ethylene refrigeration at approximately −100 to 102° C. is typically used to chill and produce overhead reflux. An ethylene plant designed with a low pressure demethanizer which operates below about 2.41 MPa (350 psi) and generally in the range of 0.345 to 1.034 MPa (50 to 150 psi) and with overhead temperatures in the range of −110 to −140° C. requires methane temperature levels of refrigeration to generate reflux. The advantage of the low pressure demethanizer is the lower total plant power requirement and the lower total plant capital cost while the disadvantage is the lower refrigeration temperature required and, therefore, the need for a methane refrigeration system in addition to the ethylene and propylene refrigeration systems.

The tertiary refrigerant of the present invention comprises a mixture of methane, ethylene and propylene. The percentage of these components can vary depending on the ethylene plant cracking feedstock, the cracking severity and the chilling train pressure among other considerations, but will generally be in the range of 7 to 20 percent methane, 7 to 30 percent ethylene and 50 to 85 percent propylene. A typical composition for an ethylene plant with a low pressure demethanizer would be 10% methane, 10% ethylene and 80% propylene. The use of the tertiary refrigerant provides all the refrigeration loads and temperatures required for an ethylene plant while obviating the need for two or three separate refrigerant systems.

The purpose of the present invention is to provide the necessary refrigeration to separate the hydrogen and methane from the charge gas and provide the feed for the demethanizer as well as provide for the other refrigeration requirements of the entire plant. Referring to the specific embodiment of the invention shown in the drawing which is for a low. pressure demethanizer, the tertiary refrigeration system is arranged to provide all of the required levels of refrigeration for an ethylene plant in the series of heat exchangers 10, 12, 14, 16, 18 and 20. These heat exchangers can be combined as fewer units or expanded into a greater number of units depending on the particular needs for any particular ethylene process and in particular on the specific charge gas composition. They are typically plate fin type heat exchangers and are preferably packed inside of a heavily insulated structure referred to as a cold box to prevent heat gain and to localize the low temperature operation. Before describing the tertiary refrigeration system, the flow of the charge gas through the system will be described with examples of specific temperatures for purposes of illustration only.

The charge gas feed 22, which is the pyrolysis gas conditioned as required and cooled, is typically at a temperature of about 15 to 20° C. and a pressure of about 3.45 MPa (500 psi), and is typically a vapor stream. The charge gas contains hydrogen, methane, and $C_2$ and heavier components including ethylene and propylene. The charge gas 22 is progressively cooled by the refrigeration system of the present invention in the heat exchangers 10, 12, 14, 16, 18 and 20 with appropriate separations being made to produce demethanizer feeds. The charge gas 22 is first cooled in the heat exchangers 10 and 12 down to about −35° C. at 23. In heat exchanger 14, the charge gas is cooled from −35° C. to −60° C. at 23. In heat exchanger 16, it is cooled from −60° C. to −72° C. with the condensate 25 in the effluent 26 being separated at 28. The condensate 25 is a lower feed to the demethanizer (not shown). The remaining vapor 30 is then cooled from −72° C. to −98° C. in heat exchanger 18 with the condensate 32 in the effluent 34 being separated at 36. This condensate 32 is a middle feed to the demethanizer. The vapor 38 is then further cooled in heat exchanger 20 from −98° C. to −130° C. with the condensate 40 in the effluent 42 being separated at 44. The condensate 40 is a top feed to the demethanizer. The remaining vapor 46 is then separated (not shown) to produce the hydrogen stream 48 and the low pressure methane stream 50. The cooling loop 52 is for cooling and partially condensing the low pressure demethanizer overhead to generate reflux. The remaining overhead vapor from the demethanizer forms the high pressure methane-stream 54. The hydrogen stream 48 and the low and high pressure methane streams 50 and 54 provide additional cooling in the heat exchangers. To complete the description of the charge gas, flow, it is the demethanizer bottoms which contains the $C_2$ and heavier components which is sent for the recovery of the ethylene and propylene and other components.

In addition to the charge gas stream and the tertiary refrigerant streams, the streams 55, 56, 57 and 58 are various ethylene plant streams at various temperatures which also pass through the heat exchangers for recuperation of cold. Merely as examples, stream 55 is for the recuperation of the cold from the low pressure demethanizer side reboiler. Stream 56 recuperates the cold from the deethanizer feed and the low pressure demethanizer bottom reboiler. Stream 57 is for recuperation of the deethanizer feed, the ethane recycle, the ethylene fractionator side reboiler and bottom reboiler and the ethylene product. The last stream 58 covers the recuperation of cold from the lower deethanizer feed, the ethylene product, the ethane recycle and the refrigeration consumed in a dual-pressure depropanizer system.

The maximum efficiency of heat transfer between a warm fluid and a cold fluid is achieved when the temperature difference is low. A mixed refrigerant, such as proposed in this invention, has an increasing temperature with increasing vaporization, at a fixed pressure. This is as distinguished from a pure component refrigerant which vaporizes at a constant temperature at a fixed pressure. Pure component refrigeration systems therefore tend to be more efficient when the process condensing temperatures are unchanged, or relatively unchanged, when being cooled, and relatively less efficient when process temperatures decrease when being cooled. For mixed refrigeration systems, such as proposed in this invention, the relative advantages are reversed.

In an ethylene plant, some of the cooling services requiring refrigeration are at relatively constant temperatures and some are at decreasing temperatures. In the pending U.S. patent application Ser. No. 09/862,253, entitled, Tertiary Refrigeration System for Ethylene Plants, and filed May 22, 2001, a mixed refrigerant system for ethylene plants is described which emphasizes a constant composition throughout the system. Thus, a somewhat lower efficiency in the constant temperature heat transfer services has been understood. The present invention proposes to improve the efficiency of the mixed refrigeration system by varying the composition of the mixed refrigerant used for these constant temperature heat transfer services. This invention is especially directed to the refrigeration system utilized in the separation of ethylene from ethane which has a very large refrigeration requirement. The concept can also be utilized for other constant temperature heat transfer services with lower heat transfer duty such as the deethanizer.

For the purposes of the present invention, the total duty of the ethylene fractionator condenser 59 is handled outside the coldbox with special consideration. Shell and tube exchangers are typically used for the ethylene fractionator condenser heat transfer service although platefin exchangers, as in the cold box, can also be utilized. As known from the thermodynamics, the condensation of the process stream with constant temperature, such as the ethylene fractionator overhead and the deethanizer overhead, as well as the depropanizer overhead if a single low pressure tower is employed, will be less efficient if a mixed refrigeration system is used where the vaporization curve is sloped with temperature. The wide cold-end temperature approach indicates inefficiency and results in higher power consumption for the tertiary refrigeration system. For the deethanizer condenser, the refrigeration can be supplied by the ethylene fractionator side reboiler with near constant temperature on both sides. However, there is no alternative for the ethylene fractionator condenser which is the biggest refrigeration consumer in the ethylene plant. To make the tertiary system competitive in power consumption to a system designed with separate compressors, a concept to generate a heavy refrigerant stream approaching the conventional propylene refrigeration is called for in the tertiary system of the present invention.

Turning now to the refrigeration system per se, the tertiary refrigerant as identified earlier is a mixture of methane, ethylene and propylene and is compressed by the multistage refrigeration compressor 60. In the illustrated embodiment, there are five compressor stages 61, 62, 64, 66 and 68 with two interstage coolers. The interstage cooler 70 is at the third stage discharge 72 while the interstage cooler 74 is at the fourth stage discharge 76. The liquid in this fourth stage discharge after cooling is separated in the drum 78, to provide the heavy refrigerant 80. The remaining vapor 82, from drum 78 is returned to the fifth compressor stage 68, and extracted as the fifth stage final effluent 84. This final effluent 84 is cooled and partially condensed at 86 and then separated in drum 88 to generate a medium refrigerant 90 and a light refrigerant 92 by phase separation. The typical operating conditions and the range of operating conditions for the compressor are as follows:

| | Range of Suction Pressure | Typical Suction Conditions | |
|---|---|---|---|
| | Mpa | Mpa | Degree C |
| 1st Stage | 0.01–0.016 | 0.014 | −40 |
| 2nd Stage | 0.4–0.55 | 0.46 | 9.0 |
| 3rd Stage | 0.7–0.95 | 0.86 | 47 |
| 4th Stage | 1.1–2.0 | 1.5 | 37 |
| 5th Stage | 2.8–3.2 | 3.0 | 45 |

The light refrigerant 92 from the drum 88 passes through all of the heat exchangers 10 to 20 and is condensed and subcooled in the process. It is subcooled to about −130° C. at the exit 94 from heat exchanger 20 and then flashed through valve 96 to provide the lowest refrigeration temperature of −140° C. to −145° C. This level of refrigeration provides the cooling of the charge gas stream at 42 down to −130° C. or lower and to provide sufficient cooling in the loop 52 to generate reflux from the demethanizer overhead.

The charge gas temperature in streams 26 and 34 are typically controlled at −72° C. and −98° C. respectively by controlling the flow of the light refrigerant in streams 98 and 100. Typically, the refrigeration supplied by the stream 102 will meet the refrigeration demand in heat exchangers 20, 18 and 16. The light refrigerant is finally superheated to −45° C. in heat exchanger 14. This provides the desired superheat temperature of 5 to 15° C. when it is mixed with portions of the heavy and medium refrigerate streams for return to the first stage suction drum 104.

The liquid 90 from the drum 88 is the medium refrigerant which is subcooled as it passes through heat exchangers 10, 12 and 14. This medium refrigerant controls the temperature of the charge gas at 23 and 24 by flashing the subcooled refrigerant through valves 106 and 108. From valve 108, the medium refrigerate flows back through heat exchangers 14 and 12 and then to the suction drum 104 for the first stage 61 of the compressor. From valve 106, the medium refrigerant flows back through heat exchangers 12 and 10 and then to the suction drum 112 for the third stage 64 of the compressor. The liquid level in drum 88 is controlled by adjusting the valve 110 and providing limited refrigeration to heat exchanger 10. This portion of the medium is then fed to the suction drum 114 for the fourth stage 66 of the compressor.

The heavy refrigerant 80 from the drum 78 is about 88% propylene. This liquid supplies two major duties, i.e., the cooling for the ethylene condenser 59 and the major refrigeration demand in heat exchanger 10 to support the self-refrigeration of the tertiary refrigeration system. The degree of subcooling of the heavy refrigerant exiting the heat exchanger 12 at 116 is flexible between −10° C. and −35° C. The following table is a summary of the suction streams to the compressor and the compressor flows.

| Stages | Type of Refrigerant | Wt % of total flow | Ave. MW |
|---|---|---|---|
| 1st Stage Suction | 100% Light Refrigerant | 9.0 | |
| | Medium Refrigerant | 3.5 | |
| | Heavy Refrigerant | 56.0 | |
| 1st & 2nd Stage Flow | | 68.5 | 38.14 |
| 3rd Stage Side Inlet | Medium Refrigerant | 3.0 | |
| 3rd Stage Flow | | 71.5 | 38.14 |
| 4th Stage Side Inlet | Medium Refrigerant | 7.0 | |
| | Heavy Refrigerant | 21.5 | |
| 4th Stage Flow | | 100 | 38.48 |
| 5th Stage Suction and Discharge Flow | Light & Medium Refrigerant | 22.5 | 34.35 |

As shown by the above table, the split of the refrigerant for the purpose of energy saving and then the recombination of the refrigerants, particularly the recombination in the first compressor stage of the light and most of the heavy refrigerants along with some medium refrigerant to provide almost 70% of the total flow in the first stage stabilizes the compressor wheels. With 70% of the total flow in the first stage and a relatively uniform molecular weight throughout, a normal speed control of the turbine by the first stage suction drum pressure becomes equally applicable to the tertiary refrigerant compressor system as to a single refrigerant compressor system. After the extraction of the heavy refrigerant from the fourth stage flow, the flow and the molecular weight in the fifth stage becomes substantially lower. However, the fifth stage compression can be designed and the loading variations can be controlled by the recycle flow to the first stage to minimize the effects. With respect to the control of the process chilling duties, the variables which can be used include the control of the critical temperature, the adjustment of the overall refrigerant composition, the adjustment of the temperatures in the separation drums 78 and 88 and the adjustment of the compressor operating conditions.

The closed loop tertiary refrigeration system with one or more side draws from the compressor inter-stages of the present invention provides a versatile system in which various refrigerant compositions can be formed and various refrigeration levels can be provided. This provides precise temperature control in an efficient and economical manner. Therefore, a single closed loop tertiary refrigeration system can adequately provide all the necessary refrigeration to the entire ethylene plant with either a low pressure or high pressure demethanizer at a competitive power consumption and a lower overall plant cost.

What is claimed is:

1. In a process for the production of olefins from a charge gas containing hydrogen, methane, ethylene and other $C_2$ and heavier hydrocarbons wherein said charge gas and additional olefin plant process streams are cooled by a refrigeration system having a series of heat exchangers, a method for cooling said charge gas and additional olefin plant process streams by the use of a tertiary refrigerant in said refrigeration system comprising the steps of:

(a) compressing a tertiary refrigerant vapor comprising a selected mixture consisting essentially of methane, ethylene and propylene in a multistage compressor having a first stage and a last state and at least one intermediate stage wherein said propylene comprises at least 50 percent of said mixture;

(b) withdrawing at least a portion of said tertiary refrigerant vapor from one of said intermediate stages;

(c) cooling said withdrawn portion of said tertiary refrigerant vapor to form a remaining tertiary refrigerant vapor and a heavy liquid refrigerant having a greater percentage of propylene than said selected mixture;

(d) separating said heavy liquid refrigerant from said remaining tertiary refrigerant vapor, and returning said remaining tertiary refrigerant vapor to and through said last stage;

(e) extracting said remaining tertiary refrigerant vapor from said last stage of said compressor and cooling to condense a portion thereof thereby forming a medium liquid refrigerant and forming a light vapor refrigerant of the uncondensed portion thereof;

(f) bringing said heavy and medium liquid refrigerants and said light vapor refrigerant into heat exchange contact with themselves and each other and with said charge gas and additional olefin plant process streams in said series of heat exchangers whereby said charge gas and additional olefin plant process streams are cooled and said heavy and medium liquid refrigerants are heated and vaporized and said light vapor refrigerant is first cooled and at least partially condensed and then vaporized; and (g) returning said light and medium and heavy vaporized refrigerants to said compressor.

2. In a process as recited in claim 1 wherein said step of withdrawing at least a portion of said tertiary refrigerant vapor from one of said intermediate stages comprises withdrawing all of said tertiary refrigerant vapor from said stage.

3. In a process as recited in claim 2 wherein said one of said intermediate stages is the penultimate stage.

4. In a process as recited in claim 1 wherein said heavy liquid refrigerant in step (c) has a propylene content greater than 85%.

* * * * *

UNITED STATES PATENT AND TRADEMARK OFFICE

CERTIFICATE OF CORRECTION

PATENT NO. : 6,637,237 B1
DATED : October 28, 2003
INVENTOR(S) : Wei et al.

It is certified that error appears in the above-identified patent and that said Letters Patent is hereby corrected as shown below:

Column 6,
Line 28, please delete "state" and replace with -- stage --.

Signed and Sealed this

Twenty-third Day of December, 2003

JAMES E. ROGAN
*Director of the United States Patent and Trademark Office*